US009488055B2

(12) United States Patent
Sparks

(10) Patent No.: US 9,488,055 B2
(45) Date of Patent: Nov. 8, 2016

(54) TURBINE ENGINE AND AERODYNAMIC ELEMENT OF TURBINE ENGINE

(75) Inventor: Scott Matthew Sparks, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 670 days.

(21) Appl. No.: 13/492,485

(22) Filed: Jun. 8, 2012

(65) Prior Publication Data

US 2013/0330183 A1 Dec. 12, 2013

(51) Int. Cl.
*F01D 9/02* (2006.01)
*F01D 5/14* (2006.01)

(52) U.S. Cl.
CPC ..... *F01D 5/145* (2013.01); *F01D 9/02* (2013.01); *F05D 2240/127* (2013.01)

(58) Field of Classification Search
CPC ..... F01D 5/145; F01D 9/02; F05D 2240/127
USPC ..... 416/235, 236 R, 236 A; 415/914
See application file for complete search history.

(56) References Cited

U.S. PATENT DOCUMENTS

| | | | | |
|---|---|---|---|---|
| 3,012,709 | A * | 12/1961 | Schnell | 416/236 R |
| 4,023,550 | A | 5/1977 | Houston | |
| 4,431,374 | A | 2/1984 | Benstein et al. | |
| 5,099,685 | A * | 3/1992 | McLean | G01M 9/04 73/147 |
| 5,927,939 | A | 7/1999 | Harada et al. | |
| 6,099,248 | A | 8/2000 | Mumm et al. | |
| 6,139,258 | A | 10/2000 | Lang, III et al. | |
| 6,431,498 | B1 | 8/2002 | Watts et al. | |
| 6,547,524 | B2 | 4/2003 | Kohli et al. | |
| 7,475,853 | B2 | 1/2009 | Segota et al. | |
| 7,484,937 | B2 | 2/2009 | Johann | |
| 7,614,588 | B2 * | 11/2009 | Birkenstock | B64C 21/06 244/200 |
| 7,914,259 | B2 | 3/2011 | Godsk | |
| 8,061,989 | B1 | 11/2011 | Liang | |
| 8,070,454 | B1 | 12/2011 | Rawlings | |
| 8,100,643 | B2 | 1/2012 | Leblanc et al. | |
| 2004/0104309 | A1 | 6/2004 | Segota et al. | |
| 2008/0121301 | A1 * | 5/2008 | Norris | 138/39 |
| 2009/0074578 | A1 | 3/2009 | Dewar et al. | |
| 2011/0182746 | A1 | 7/2011 | Fial | |
| 2011/0229321 | A1 | 9/2011 | Kilaras | |
| 2012/0018021 | A1 | 1/2012 | Babinsky et al. | |

FOREIGN PATENT DOCUMENTS

| | | | |
|---|---|---|---|
| DE | 102006038060 | A1 | 2/2008 |
| EP | 2369133 | A1 | 9/2011 |
| WO | 2011077424 | A1 | 6/2011 |

OTHER PUBLICATIONS

Search Report from EP Application No. 13170779.6 dated Sep. 12, 2013.

* cited by examiner

*Primary Examiner* — Eric Keasel
*Assistant Examiner* — Maxime Adjagbe
(74) *Attorney, Agent, or Firm* — Ernest G. Cusick; Frank A. Landgraff

(57) ABSTRACT

A turbine engine is provided and includes an aerodynamic element disposed to aerodynamically interact with a flow of working fluid and contour features disposed on the aerodynamic element in alignment in at least one dimension. The contour features are proximate to one another and configured to encourage counter-rotating vortex flow generation oriented substantially perpendicularly with respect to a main flow direction along the aerodynamic element.

8 Claims, 4 Drawing Sheets

TURBINE ENGINE AND AERODYNAMIC ELEMENT OF TURBINE ENGINE

BACKGROUND OF THE INVENTION

The subject matter disclosed herein relates to turbomachines and, more particularly, to turbine engines having aerodynamic elements configured to provide for delayed flow separation.

A typical turbomachine, such as a gas turbine engine, includes a compressor, a combustor, a turbine and a diffuser. The compressor compresses inlet air and the combustor combusts the compressed inlet air along with fuel. The high energy products of this combustion are directed toward the turbine where they are expanded in power generation operations. The diffuser is disposed downstream from the turbine and serves to reduce the remaining energy of the combustion products before they are exhausted to the atmosphere.

Generally, the diffuser includes an outer wall, a center body disposed within the outer wall to define an annular pathway and one or more vanes traversing the annular pathway. During baseline turbomachine operations, velocities of the combustion products flowing through the diffuser are sufficiently high and flow separation from the surfaces of the one or more vanes is not exhibited. However, at part load operations, such as gas turbine engine start-up or turn-down sequences, the combustion product velocities are reduced or high angle-of-attack conditions are in effect and flow separation tends to occur. This flow separation leads to decreased performance of the diffuser.

BRIEF DESCRIPTION OF THE INVENTION

According to one aspect of the invention, a turbine engine is provided and includes an aerodynamic element disposed to aerodynamically interact with a flow of working fluid and contour features disposed on the aerodynamic element in alignment in at least one dimension. The contour features are proximate to one another and configured to encourage counter-rotating vortex flow generation oriented substantially perpendicularly with respect to a main flow direction along the aerodynamic element.

According to another aspect of the invention, an aerodynamic element of a turbine engine is provided and includes an annular inner wall disposed within an annular outer wall to define an annular pathway, the annular inner wall including an angular break defining an axial location at which the annular pathway increases in area at a faster rate along an axial dimension aft of the angular break than along an axial dimension forward from the angular break and at least first and second contour features disposed on the annular inner wall. The first and second contour features are proximate to the angular break and substantially aligned along the axial location.

According to yet another aspect of the invention, an aerodynamic element of a turbine engine is provided and includes an annular inner wall disposed within an annular outer wall to define an annular pathway, the annular inner wall including an angular break defining an axial location at which the annular pathway increases in area at a faster rate along an axial dimension aft of the angular break than along an axial dimension forward from the angular break and contour features arrayed on the annular inner wall, each contour feature being proximate to the angular break and an adjacent contour feature. Each of the contour features is substantially aligned along the axial location to encourage a generation of counter-rotating vortex flows oriented substantially perpendicularly with respect to a main flow direction along the annular inner wall These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
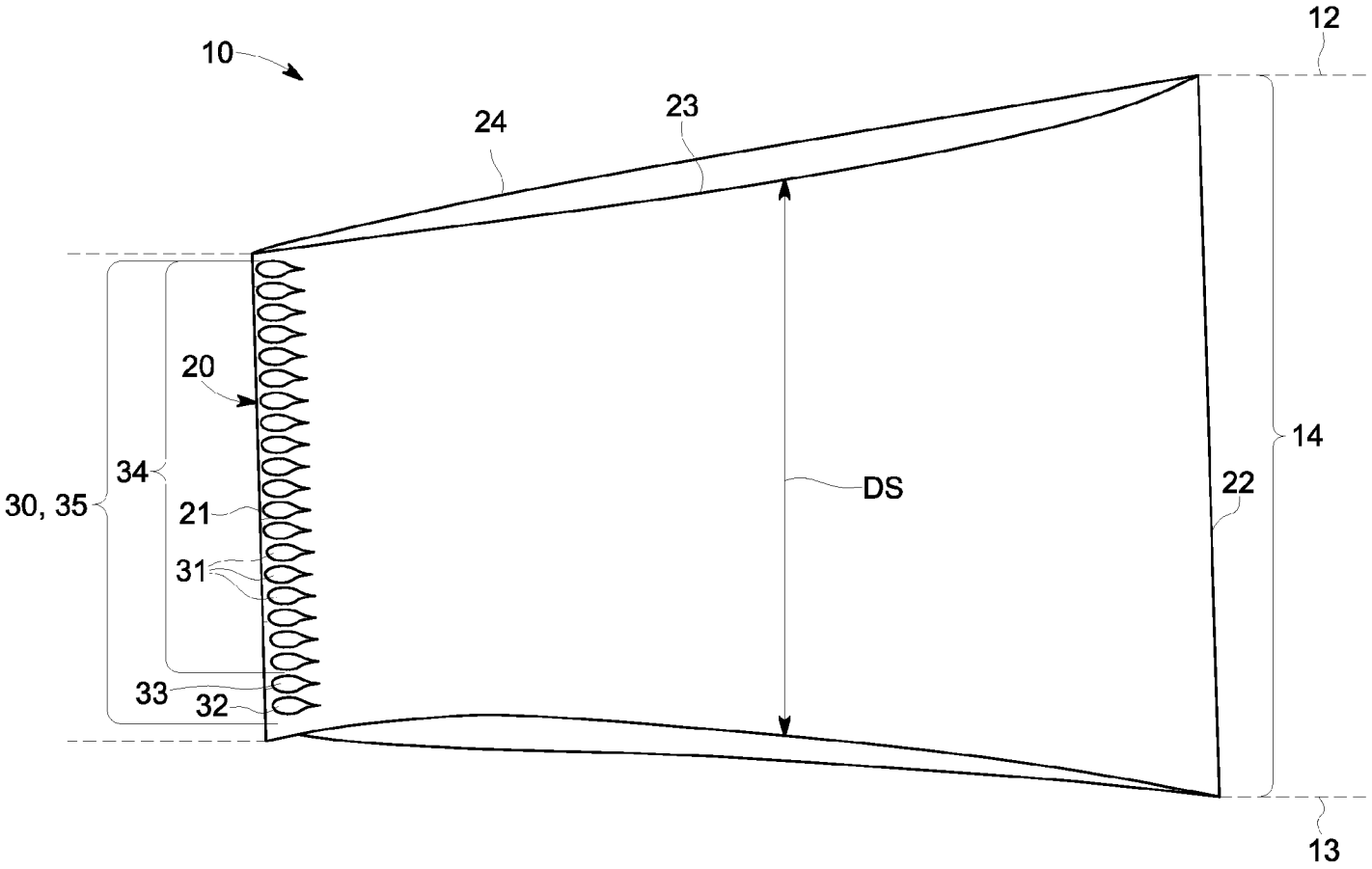
FIG. 1 is a side view of a portion of a turbine engine including an aerodynamic element.

The detailed description explains embodiments of the invention, together with advantages and features, by way of example with reference to the drawings.

DETAILED DESCRIPTION OF THE INVENTION

In accordance with aspects of the invention, delayed flow separation in one or more portions of a turbomachine is provided for by the creation of counter-rotating vortex flows along, for example, a low-pressure surface (i.e., a suction side) of an airfoil or vane. The delayed flow separation is particularly useful during relatively high angle-of-attack conditions associated with turn-down operations of the turbomachine. The delayed flow separation is facilitated through the addition of contours, such as bumps, protrusions or indentations, to the low-pressure surface of the airfoil or vane that encourage tangential counter-rotating vortex flow structures to form along lines defined perpendicularly with respect to a main flow direction through the turbomachine of a working fluid.

With reference to FIGS. 1-4, one or more portions of a turbomachine 10, such as a gas turbine engine, are provided. As an example, the turbomachine 10 portion may be a diffuser section 11 (see FIG. 7), which is disposed downstream from a turbine section to reduce a remaining energy of combustion products exiting the turbine section before they are exhausted to the atmosphere. The diffuser section 11 includes an annular outer wall 12, such as a diffuser casing, and an annular inner wall 13, which may be provided as an exterior surface of a center body. The annular inner wall 13 is disposed within the annular outer wall 12 to define an annular pathway 14 through which a working fluid, such as the combustion products, may be directed (see FIG. 7).

The diffuser section 11 further includes an aerodynamic element 20, such as a diffuser vane, which is disposed to traverse the annular pathway 14 to thereby aerodynamically interact with the working fluid. The aerodynamic element 20 includes a leading edge 21 defined with respect to a predominant direction of a flow of the working fluid through the pathway 14 and a trailing edge 22 defined at an opposite chordal end of the aerodynamic element 20 from the leading edge 21. The aerodynamic element 20 further includes a suction side 23 and a pressure side 24, which are disposed on opposite sides of the aerodynamic element 20 and respectively extend from the leading edge 21 to the trailing edge 22.

In accordance with embodiments of the invention, an array of contour features 30, including individual contour features 31, is provided on the suction side 23 at a chordal location proximate to the leading edge 21 of the aerodynamic element 20. Each individual contour feature 31 is disposed relatively closely to another (i.e., adjacent) individual contour feature 31. The array of contour features 30 includes at least a first contour feature 32 and a second contour feature 33 and, in some cases, additional contour features 34. For purposes of clarity and brevity, the description below will simply describe a plurality of contour features 35 that includes the above-mentioned contour features.

Each one of the plurality of contour features 35 is substantially aligned with an adjacent one of the plurality of contour features 35 along a spanwise dimension, DS, of the aerodynamic element 20. This alignment and the shapes of the plurality of contour features 35, which will be described below, encourages the generation of tangential counter-rotating vortex flows 40 (see FIG. 4) along the suction side 23 relative to a base flow of the working fluid that proceeds along a substantially straight path through the turbomachine 10 in a main flow direction 50 (see FIG. 4). Due to the shapes of the plurality of contour features 35, the counter-rotating vortex flows 40 may be oriented substantially perpendicularly with respect to the main flow direction 50 of the working fluid. Thus, the counter-rotating vortex flows 40 combine to create an enhanced jet of entrained and energized flow 60 along the suction side 23. The entrained and energized flow 60 (see FIG. 4) maintains boundary layer stability along the suction side 23 and thereby delays or prevents flow separation from the suction side 23 in certain applications, such as those present during high angle-of-attack inlet conditions.

Figure 4:
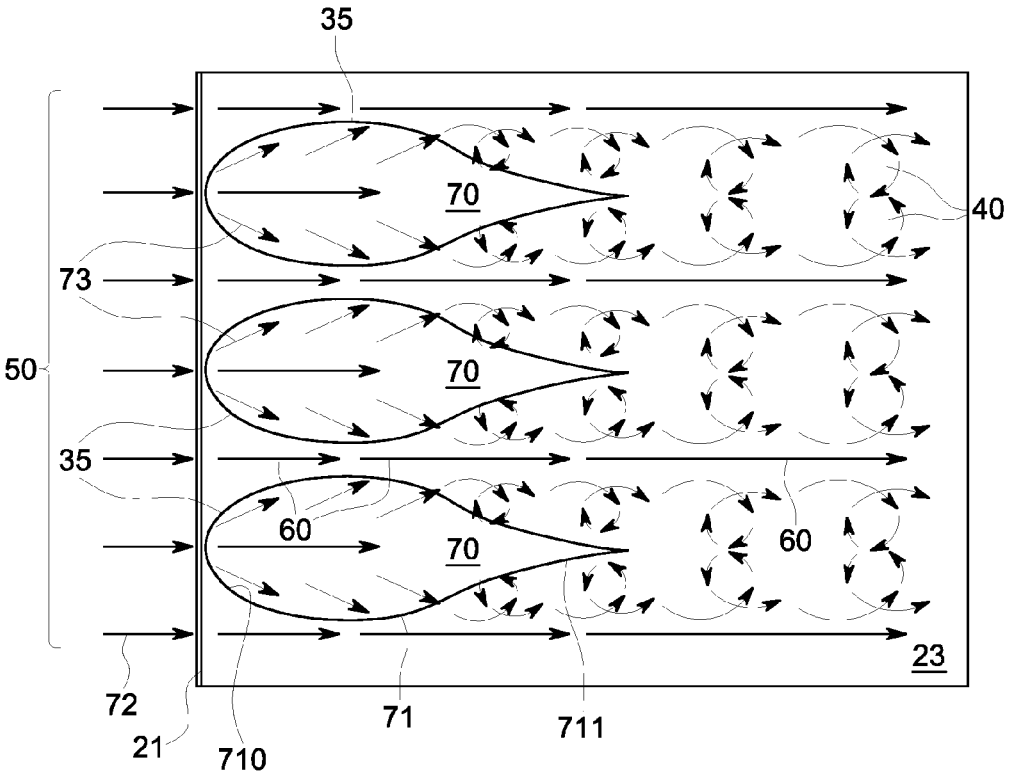
FIG. 4 is an enlarged view of a suction side of the aerodynamic element of FIG. 1.

As shown in FIG. 4, the counter-rotating vortex flows 40 are defined on either side of each enhanced jet of entrained and energized flow 60. At various and discrete axial positions, the counter-rotating vortex flows 40 are provided as pairs of flow vortices. Within each individual flow vortex, working fluid flows toward a mid-line of the corresponding contour feature 35 and then away from the mid-line in an elliptical pattern. The pairs of flow vortices may propagate in the aft axial direction or be fixed in the discrete axial positions.

Figure 2:
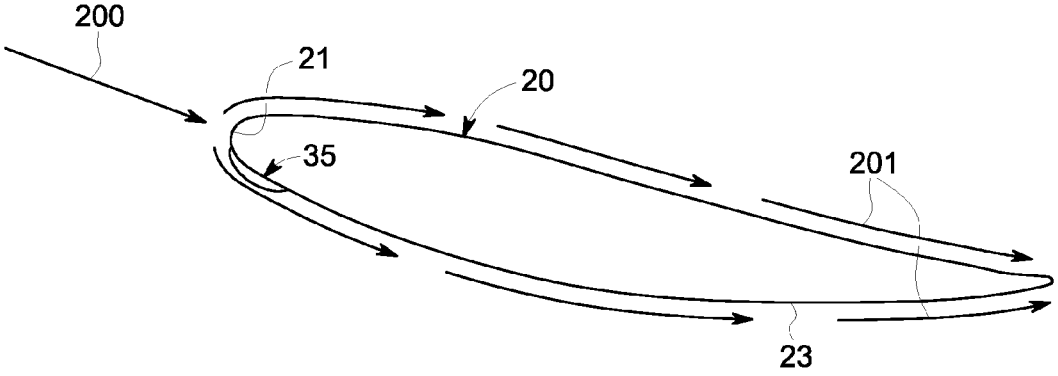
FIG. 2 is a radial view of the aerodynamic element of FIG. 1 during baseline operations.
Figure 3:
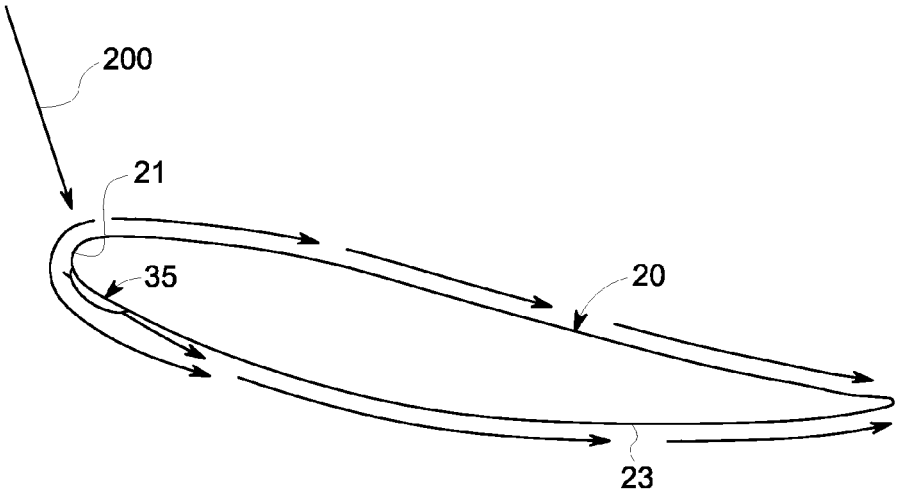
FIG. 3 is a radial view of the aerodynamic element of FIG. 1 during part load operations.

With reference to FIGS. 2 and 3, a single aerodynamic element 20 and a flow of working fluid 200 are illustrated with the assumption that the illustration is reflective of baseline or design point conditions. As shown, the flow of working fluid 200 has a relatively low angle-of-attack relative to the leading edge 21 and, therefore, the flow of working fluid 200 flows around the aerodynamic element 20 with relatively stable boundary layers 201. During part load conditions associated with, for example, turn-down operations of the turbomachine 10, the flow of working fluid 200 will tend to have a relatively high angle-of-attack, as shown in FIG. 3. Normally, this would tend to de-stabilize the boundary layers 201 and lead to flow separation but, since the suction side 23 is provided with the plurality of contour features 35, the boundary layers 201 remain relatively stable. The presence of the plurality of contour features 35 does not substantially affect the flow of working fluid 200 around the aerodynamic element 20 in the case illustrated in FIG. 2.

Each one of the plurality of contour features 35 may include a protrusion 70 disposed on the suction side 23 of the aerodynamic element 20 at a chordal location that is proximate to the leading edge 21. As shown in FIG. 4 and, in accordance with embodiments, each one of the plurality of contour features 35 may have a substantially similar teardrop shape 71 with a bulbous, convex front end 710 and a narrowed, concave tail end 711. For those cases, where each one of the plurality of contour features 35 has a substantially similar shape as another one of the plurality of contour features 35, the teardrop shape 71 causes approaching flows 72 to diverge over a surface of the protrusion 70 to thereby generate pairs of converging flows 73 between adjacent protrusions 70. With adjacent protrusions 70 being sufficiently close to one another, the pairs of converging flows 73 interact with one another and with the surrounding flows to generate the counter-rotating vortex flows 40 that propagate along the suction side 23 to thereby create the enhanced jet of entrained and energized flow 60 along the suction side 23.

Figure 5:
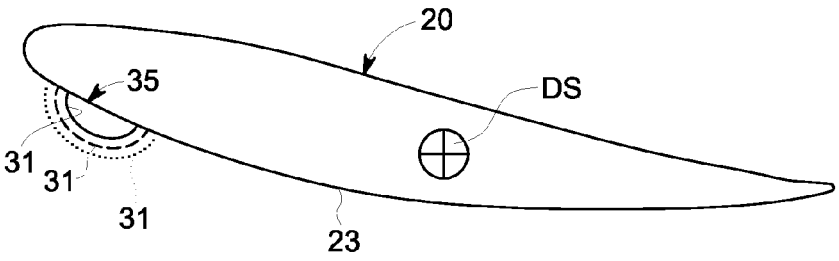
FIG. 5 is a radial view of the aerodynamic element of FIG. 1 in accordance with further embodiments.

While FIGS. 1-4 relate to embodiments in which each one of the plurality of contour features 35 has a similar shape, it is to be understood that this is merely exemplary and that other embodiments exist. For example, with reference to FIG. 5, the individual contour features 31 of the plurality of contour features 35 may have steadily varying shapes or sizes along the spanwise dimension, DS, of the aerodynamic element 20. This is illustrated in FIG. 5 with each dotted, dashed or solid line identifying an individual contour feature 31 having a unique size at steadily increasing, respective spanwise locations of the aerodynamic element 20.

Figure 6:
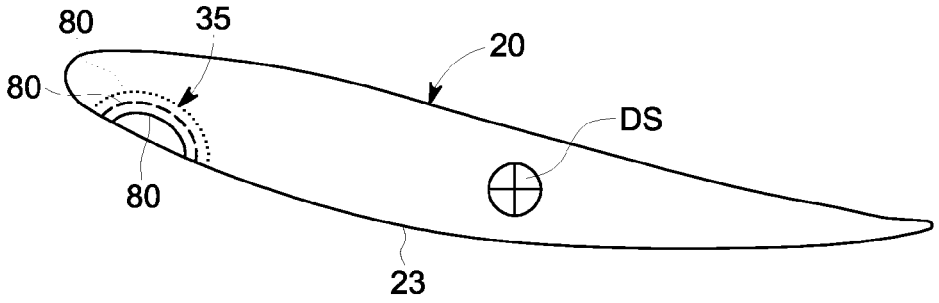
FIG. 6 is a radial view of the aerodynamic element of FIG. 1 in accordance with alternative embodiments.

With reference to FIG. 6 and, in accordance with alternative embodiments, each one of the plurality of contour features 35 may be formed as a depression 80 defined in the suction side 23. For these alternative embodiments, it is to be understood that the variations described above with reference to FIG. 5 apply here as well. That is, the shapes and sizes of the depressions 80 may be uniform or steadily varied along the spanwise dimension, DS, of the aerodynamic element 20.

Figure 7:
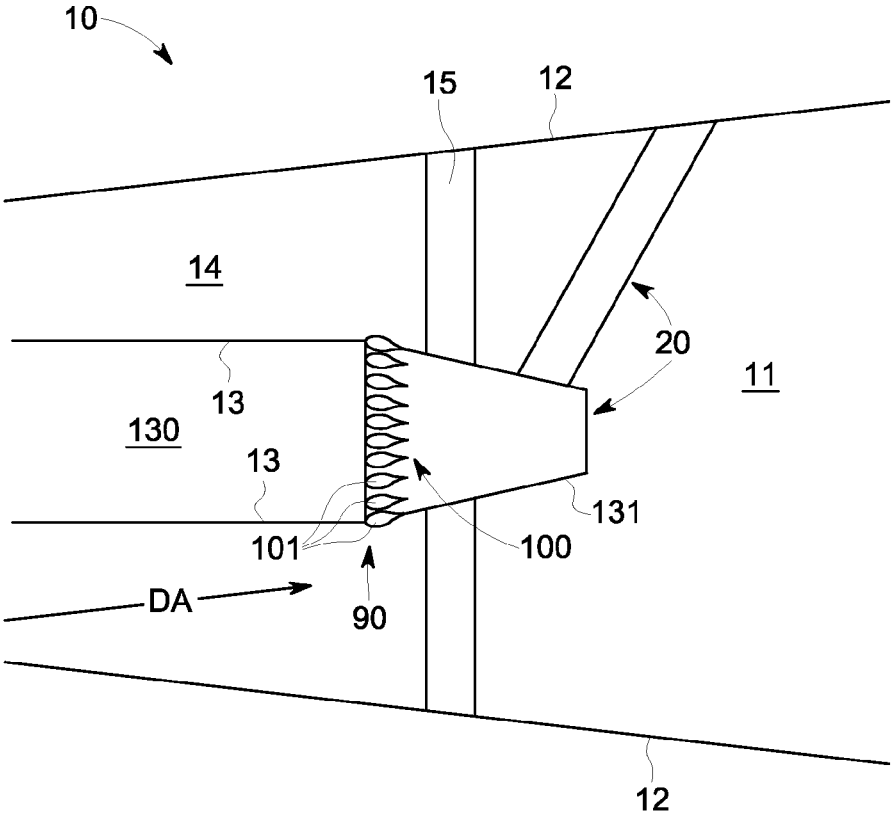
FIG. 7 is a side view of a diffuser of a turbine engine including an aerodynamic element in accordance with further embodiments.

With reference to FIG. 7, the particular case in which the turbomachine 10 portion is provided as a diffuser section 11 is shown. As noted above, the diffuser section 11 is disposed downstream from a turbine section to reduce a remaining energy of combustion products exiting the turbine section before the combustion products are exhausted to the atmosphere. The diffuser section 11 includes an annular outer wall 12, such as a diffuser casing, and an annular inner wall 13, which is provided as an exterior surface of center body 130. The annular inner wall 13 is disposed within the annular outer wall 12 to define an annular pathway 14 through which a working fluid, such as the combustion products, may be directed.

The diffuser section 11 may further include a manway 15, which traverses the annular pathway 14 and an aerodynamic element 20, which may be provided as the diffuser vane described above or at an axial end of the center body 130 as a center body end component 131. As shown in FIG. 7, the center body 130 has a substantially uniform diameter while the annular outer wall 12 has an increasing diameter along an axial dimension, DA, of the diffuser section 11. This configuration results in an area of the annular pathway 14 increasing along the axial dimension, DA, which, in turn, leads to the energy reduction of the working fluid. In contrast to the configuration of the center body 130, the center body end component 131 has a decreasing diameter along the axial dimension, DA, such that, along the axial length of the center body end component 131, the area of the annular pathway 14 increases at a relatively fast rate as compared to relatively slow increases in the area of the annular pathway 14 along an axial length of the center body 130 defined forwardly from the center body end component 131.

An angular break 90 is defined at an attachment location between the center body 130 and the center body end component 131, although it is to be understood that the center body 130 and the center body end component 131 may be integrally coupled. The angular break 90 defines an axial location at which the annular pathway 14 increases in area along the axial dimension, DA, at the relatively fast rate.

The annular inner wall 13, which is provided as the exterior surface of center body 130 and the center body end component 131, includes an array of endwall contour features 100. The array of endwall contour features 100 includes individual endwall contour features 101 and is disposed at an axial location defined proximate to the angular break 90. That is, the array of endwall contour features 100 may be disposed just forward or just aft of the angular break 90. The array of endwall contour features 100 may be configured substantially similarly as the array of contour features 30 described above and additional description of the same is therefore omitted.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine engine, comprising:

an aerodynamic element disposed to aerodynamically interact with a flow of working fluid; and more than two contour features disposed on the aerodynamic element in alignment in at least one dimension, the contour features being proximate to one another and configured to encourage counter-rotating vortex flow generation oriented substantially perpendicularly with respect to a main flow direction along the aerodynamic element, wherein the aerodynamic element comprises an annular inner wall of a diffuser, the diffuser comprising a center body having a substantially uniform diameter and a center body end component having a decreasing diameter along an axial dimension thus defining an annular pathway, wherein, along an axial length of the center body end component, an area of an annular pathway increases at a relatively fast rate as compared to relatively slow increases in the area of the annular pathway along an axial length of the center body defined forwardly from the center body end component;

and the contour features each have a same teardrop shape, are all oriented in parallel with one another and are aligned at an angular break defined along the annular inner wall, wherein each teardrop shaped contour feature comprises a bulbous front end and a narrowed tail end; and wherein the bulbous front end has a convex shape and the narrowed tail end has a concave shape and thereby causes approaching flows to diverge over a surface of the protrusion to thereby generate pairs of converging flows between adjacent protrusions.

2. The turbine engine according to claim 1, wherein each of the contour features comprises a protrusion.

3. The turbine engine according to claim 1, wherein each of the contour features comprises a depression.

4. An aerodynamic element of a turbine engine, comprising:

an annular inner diffuser wall disposed within an annular outer wall to define an annular pathway, the annular inner diffuser wall including an angular break defining an axial location at which the annular pathway increases in area at a faster rate along an axial dimension aft of the angular break than along an axial dimension forward from the angular break; and more than two contour features disposed on the annular inner diffuser wall, the diffuser comprising a center body having a substantially uniform diameter and a center body end component having a decreasing diameter along an axial dimension thus defining an annular pathway, wherein, along an axial length of the center body end component, an area of an annular pathway increases at a relatively fast rate as compared to relatively slow increases in the area of the annular pathway along an axial length of the center body defined forwardly from the center body end component; and each of the more than two contour features having a same teardrop shape, being all oriented in parallel with one another and being proximate to the angular break and substantially aligned along the axial location, wherein each teardrop shaped contour feature comprises a bulbous front end and a narrowed tail end; and wherein the bulbous front end has a convex shape and the narrowed tail end has a concave shape and thereby causes approaching flows to diverge over a surface of the protrusion to thereby generate pairs of converging flows between adjacent protrusions.

5. The aerodynamic element of the turbine engine according to claim 4, wherein each of the more than two contour features comprises one of a protrusion or a depression.

6. The aerodynamic element of the turbine engine according to claim 4, wherein each of the more than two contour features have substantially similar shapes.

7. An aerodynamic element of a turbine engine, comprising:

an annular inner diffuser wall disposed within an annular outer wall to define an annular pathway, the annular inner diffuser wall including an angular break defining an axial location at which the annular pathway increases in area at a faster rate along an axial dimension aft of the angular break than along an axial dimension forward from the angular break; and more than two contour features arrayed on the annular inner diffuser wall, each of the contour features having a same teardrop shape, being all oriented in parallel with one another and being proximate to the angular break and an adjacent contour feature, the diffuser comprising a center body having a substantially uniform diameter and a center body end component having a decreasing diameter along an axial dimension thus defining an annular pathway, wherein, along an axial length of the center body end component, an area of an annular pathway increases at a relatively fast rate as compared to relatively slow increases in the area of the annular pathway along an axial length of the center body defined forwardly from the center body end component, and each of the contour features being substantially aligned along the axial location to encourage a generation of counter-rotating vortex flows oriented substantially perpendicularly with respect to a main flow direction along the annular inner diffuser wall, wherein each teardrop shaped contour feature comprises a bulbous front end and a narrowed tail end; and wherein the bulbous front end has a convex shape and the narrowed tail end has a concave shape.

8. The aerodynamic element of the turbine engine according to claim 7, wherein each of the contour features comprises one of a protrusion or a depression.

* * * * *